United States Patent [19]

Berger

[11] 4,022,222

[45] May 10, 1977

[54] TOBACCO SMOKE FILTER

[75] Inventor: Richard M. Berger, Richmond, Va.

[73] Assignee: American Filtrona Corporation, Richmond, Va.

[22] Filed: Nov. 6, 1975

[21] Appl. No.: 629,663

[52] U.S. Cl. ..... 131/10.5; 131/261 B
[51] Int. Cl.[2] ..... A24F 7/04
[58] Field of Search ..... 131/10.5, 10.7, 10.9, 131/10.3, 10 R, 261 B, 261 R, 201, 202, 207, 264–269

[56] References Cited

UNITED STATES PATENTS

| | | | |
|---|---|---|---|
| 3,059,649 | 10/1962 | Bernhard | 131/10.5 |
| 3,313,306 | 4/1967 | Berger et al. | 131/266 X |
| 3,690,326 | 9/1972 | Davenport | 131/10.5 |
| 3,888,160 | 6/1975 | Westcott et al. | 131/261 B X |

FOREIGN PATENTS OR APPLICATIONS

| | | | |
|---|---|---|---|
| 1,341,077 | 12/1973 | United Kingdom | 131/261 B |

*Primary Examiner*—John F. Pitrelli

[57] ABSTRACT

Tobacco smoke filters wherein the products have an elongated hollow inner member overwrapped with a conventional plug wrap, with an intermediate member interposed therebetween. The intermediate member is comprised preferably of a filtering material different from that which forms the inner member so as to provide selective filtration through the two layers of filtering material, the intermediate member functioning to remove larger particles of undesirable material so that the interstitial spaces of the inner member are not clogged thereby. Moreover, the presence of the intermediate member provides a smooth outer surface for attaching a conventional plug wrap without the need for an internal glue line.

9 Claims, 10 Drawing Figures

TOBACCO SMOKE FILTER

This invention relates to the production of filter means, and relates more particularly to tobacco smoke filter elements. More specifically, the instant inventive concepts are primarily concerned with producing filter means for cigarettes, although the products of this invention are generally useful as filters, particularly for tobacco smoking means, whether they be cigarettes, cigars, pipes or the like. Since filters for cigarettes are particularly commercially important, the basic embodiments of the instant invention will be discussed as they relate to the production of filtered cigarettes.

Various prior art techniques are known for making filters for use in connection with cigarettes and the like, although the resultant products, in general, have one or more disadvantages. Perhaps the most important property of the filter means is its efficiency, that is, its ability to remove undesirable constituents from tobacco smoke. Filtration efficiency is ordinarily measured in terms of the percentage of total particulate material (TPM) removed from the smoke, although there is also some concern for the percentage of gas phase constituents which a filter means is capable of removing. While filtration efficiency is perhaps the most important property of cigarette filter means, other properties must also be considered, including pressure drop, taste, hardness, appearance and cost. It is necessary to produce a filter which satisfies commercial requirements in each of these areas. Frequently, a compromise of certain properties is required in order to satisfy the need for others. For example, the most commonly utilized cellulose acetate filter means has a relatively low filtration efficiency since increased efficiency can only be obtained either by increasing the density of the filter material or the length of the filter element, both of which produce a pressure drop across the filter which is excessive and unacceptable from a commercial standpoint. While various suggestions have been made for the production of filter means which have improved filtering properties, most prior art developments have not been commercially acceptable either because the resulting means have been found to have objectionable "taste" characteristics whereby cigarettes provided with such filtering means fail to satisfy a large segment of the smoking public, or because the techniques and/or the materials utilized in the production of such filter means have increased the cost excessively.

High filtration efficiency is considered by the industry to be removal of 60% or more of total particulate matter. Cigarette filters having such properties are presently being produced in accordance with the teachings of U.S. Pat. Nos. 3,533,416, 3,599,646, 3,637,447, 3,648,711, 3,805,801 and 3,810,477, all of which are commonly assigned with the instant application. The disclosures of these prior art patents are incorporated herein in their entirety by reference.

While such filters are highly desirable from a commercial standpoint, particularly as compared to other prior art filters, it is always desirable to be able to improve one or more of the foregoing properties without significantly affecting other such properties negatively. Thus, it would be readily recognized that improvement of filtration efficiency while maintaining a relatively low pressure drop without undue increase in manufacturing costs would be a valuable capability. The instant inventive concepts are directed to the production of a filter means of this nature.

Thus, it is a primary object of this invention to provide a cigarette filter means or the like and a method and means for manufacturing same wherein the products have a high filtration efficiency, satisfactory pressure drop and other commercial requirements, and wherein the method and means utilized enable high speed production of the final product.

A further object of this invention is to provide a cigarette filter having a layered-like arrangement which enables selective removal of large particles size constituents in tobacco smoke by a radially outward layer so as to avoid clogging the interstitial spaces of a radially inward layer.

Another object of this invention is the provision of a filter means of the type described wherein areas of prior art arrangements that had merely been air spaces required for proper smoke flow characteristics are filled with a filtering material which increases the filtration efficiency while still providing proper flow arrangements.

Yet another object of this invention is the provision of a cigarette filter having an inner member with both inner and outer cavities to improve the flow path of tobacco smole and enable greater utility of the filter material from which it is made, while incorporating an intermediate surrounding member having a substantially continuous exterior surface throughout its length to uniformly support the overwrap enabling the use of relatively light weight conventional plug wrap withput requiring an internal glue line to provide a smoke seal as has been necessary with certain prior art techniques.

Another object of this invention is to provide a cigarette filter or the like having an intermediate member interposed between the inner member and the plug wrap, wherein the inner member and the intermediate member can be made of different materials to provide advantageous filtration characteristics, as well as to provide certain novel effects from an appearance standpoint in the final product.

Other and further objects of this invention reside in the chemical and physical characteristics of the filter product, as well as the manipulative steps utilized in the production and the various features of construction found in the manufacturing apparatus. Still other objects will in part be obvious and in part be pointed out as the description of the invention proceeds, and as will be seen from the accompanying drawings, wherein.

Like reference characters refer to like parts throughout the several views of the drawings.

Figure 1:
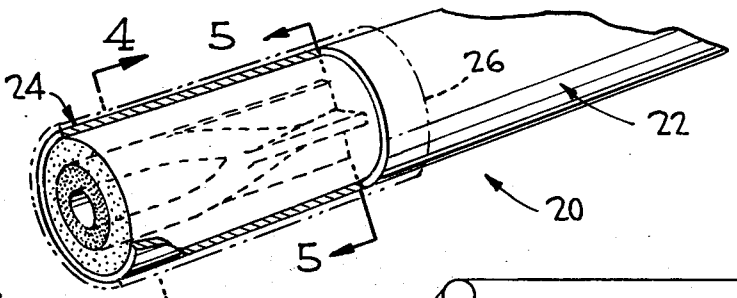
FIG. 1 is an enlarged perspective view of one form of filtered cigarette produced according to the invention, parts being broken away for illustrative clarity and convenience.
Figure 2:
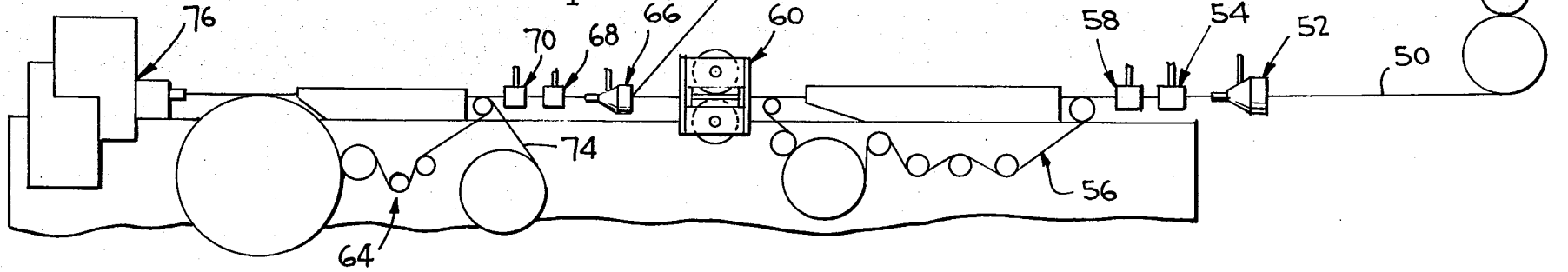
FIG. 2 is a schematic view of a method and means for making filter elements according to the instant inventive concepts.

Referring now to the drawings, and more particularly to FIG. 1, a filtered cigarette according to the instant inventive concepts is designated generally by the reference numeral 20 and comprises basically a tobacco rod shown partially at 22 and a filter element according to one embodiment of this invention designated generally by the reference numeral 24, a conventional tipping overwrap being shown in dotted lines at 26 securing the tobacco rod and the filter element in end-to-end relationship according to well known prior art techniques.

Filter element 24 comprises basically an axially elongated, hollow, inner member 28, an axially elongated, hollow, outer member 30 formed by conventional plug wrap as well be explained hereinafter in more detail, and an axially elongated, hollow, intermediate member 32 disposed between the inner and outer members 28,30, at least substantially throughout their lengths.

The inner and intermediate members 28, 32 are preferably and primarily formed from a continuous tow of cellulose acetate filamentary material, although other filtering material may be used with slight modifications. For example, filamentary tow formed of other material such as polyethylene, polypropylene and the like or even non-woven staple fibers of the type described in some detail in U.S. Pat. Nos. 3,297,041 and 3,552,400, also commonly assigned, the disclosures of which are incorporated herein by reference, may be used for either of the foregoing members. In fact, it is even possible to produce filter elements according to this invention wherein one or both of the inner and intermediate members are produced from an extruded, open celled foamed material, such as cellulose acetate foam or the like. However, since cellulose acetate filamentary tow is the presently preferred material from a commercial standpoint, the remainder of this specification will be directed to the use of such material for both the inner and intermediate members 28, 32, respectively.

Thus, both the inner and intermediate members 28, 32 are preferably formed of crimped filamentary cellulose acetate members bonded together at their contact points to form smoke-permeable elements defining tortuous paths for passage of smoke therethrough. Filtering material of this nature is well known, as are techniques for producing same. While the filtering materials of both the inner and intermediate members 28, 32 are formed of crimped filamentary cellulose acetate tow, it is preferable that the fibers of the filamentary tow of the inner member 28 be finer than the fibers of the filamentary tow of the intermediate member 32, resulting in an inner member 28 having interstitial spaces which are smaller than the interstitial spaces in the intermediate member 32. For example, the inner member 28 may be made of fine 1.6 denier per filament cellulose acetate fibers overwrapped in a manner to be described in more detail hereinafter with a strand of larger, 5 or 8 denier per filament, tow.

Moreover, in order to offer novelty in the final product from an esthetic standpoint, it is possible to utilize differently colored tow materials for the production of the inner and intermediate members 28, 32, respectively, or materials having different filtration characteristics with respect to both solid and gas phase constituents of smoke passing through the filter means.

By utilizing dissimilar materials for production of the inner and intermediate members 28,32, the resultant product offers filtration advantages and a depth media. Thus, the relatively large interstitial spaces in the intermediate member 32 are capable of removing relatively larger particles of undesirable constituents from the smoke precluding the possibility that the relatively finer interstitial spaces in the inner member 28 would be clogged by such material and unable to filter finer particles of undesirable constituents from the smoke.

Additionally, it will be seen that the presence of the intermediate member 32, which substantially completely occupies the normal air space of filter members made according to the foregoing patents, utilizes this air space for filtration, improving the overall efficiency of the final product.

Finally, the smooth outer surface of the intermediate member 32, in contrast to the outer surface of the crimped inner member 28, provides substantially uniform support throughout the entire length for the outer member 30 avoiding the need for an internal glue line as was required with prior art products. Additionally, since the crimping of the inner member 28 tends to distort the roundness of this member, prior art techniques require the use of a relatively heavier weight plug wrap to remove this distortion and produce a truly cylindrical final product. With a filter according to this invention, the intermediate member 32, which is not crimped, assists in producing a truly round shape for the final product, enabling the use of a more conventional, light weight plug wrap for the outer member 30.

Figure 4:
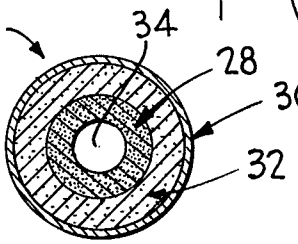
FIG. 4 is a transverse cross-sectional view through the filter element of the filtered cigarette of FIG. 1, taken substantially along lines 4—4 of FIG. 1.

As will be seen particularly from FIG. 4, the outer surface of the intermediate member 32 is juxtaposed to the inner surface of the outer member 30 to at least substantially preclude axial passage of smoke across the area therebetween, with the inner surface of the intermediate member 32 being juxtaposed to the outer surface of the inner member 28 to at least substantially preclude the axial passage of smoke across the area between these surfaces. Although the filtering material of the intermediate member offers less resistance to passage of smoke than the filtering material of the inner member, and small amounts of smoke may pass axially through the material, this long axial path as compared with the short radial path to the internal cavity 34 through the somewhat denser filtering material of the inner member, combined with the relatively high suction produced in the internal cavity 34 has been found to result in the large majority of the smoke passing through the filtering materials of both the inner and intermediate members 28, 32 as well as the internal cavity 34 before reaching the mouth of the user. The inner member will be seen to be crimped at spaced locations 36 to produce fins or the like and to close off the ends of the inner cavity 34.

Figure 5:
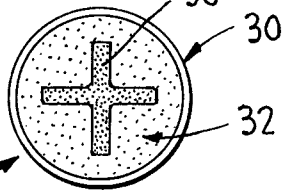
FIG. 5 is an end elevational view of the filter element of the embodiment of FIG. 1 taken substantially along lines 5—5 of FIG. 1.

While the filter means 24 has been shown in FIG. 1 as having the crimped portions 36 of the inner member 28 juxtaposed to the tobacco section 22 of the filtered cigarette, it is, of course, possible to reverse the filter means 24 so that the open area formed by the inner cavity is juxtaposed to the tobacco section 22 providing a mouth piece having a design such as shown, for example, in FIG. 5 or presenting any other crimped section at the mouth piece end of the filtered cigarette.

Figure 3:
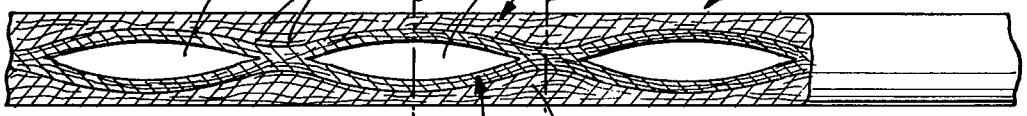
FIG. 3 is a fragmentary view of a filter rod produced according to this invention, parts being in section and parts being broken away for illustrative clarity.

In FIG. 3 a continuous rod 40 made up of a multiplicity of integrally connected filter elements of the type shown at 24 in FIG. 1 will be seen. This rod is severed transversely along the lines 42, 44, to produce individual filter elements such as shown at 24. Of course, the rod could be severed at other locations to produce filter elements of multiple length. Moreover, it is common practice to initially produce double filters which are then secured to two tobacco sections by a common tipping overwrap following which individual filtered cigarettes are formed by severing the double filters at its midpoint.

Figure 6:
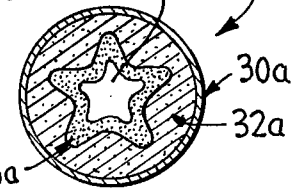
FIG. 6 is a transverse cross-sectional view similar to FIG. 4 through a modified embodiment of the instant inventive concepts wherein the inner member is formed of a pleated filtering material.
Figure 7:
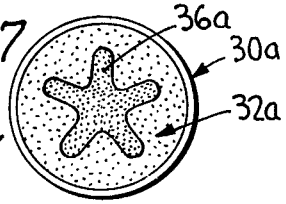
FIG. 7 is an end elevational view similar to FIG. 5 of the filter element shown in FIG. 6.

Reference is now made to FIGS. 6 and 7 for another embodiment of filter element which may be produced utilizing the present inventive concepts. Since this embodiment is similar to the embodiment of FIGS. 1, 3 and 4 with the exception of the form of the inner member, similar parts are designated by the same reference numeral followed by the suffix "*a*." The particular construction and techniques of this invention enable the use of an inner member **28*a* formed of a longitudinally pleated filtering material. The term "pleated" as it is used herein is intended to convey the fact that the material of the inner member, as will be seen particularly in FIG. 6, is of substantially uniform wall thickness throughout its entire length. A construction of this nature provides significantly more filtering material for filtration purposes than would result if the inner member were merely "crimped" to produce outer cavity means as is shown in the foregoing prior patents. With the prior art techniques the use of a pleated inner member was not possible since it was necessary to have spaced portions wherein the outer surface of the inner member was directly juxtaposed to the inner surface of the outer member to preclude axial passage of smoke therebetween. In the absence of such "sealed" areas proper smoke flow could not be realized. However, with the incorporation of an intermediate member such as shown at 32*a*, bypassing of the smoke can be avoided without providing continuous peripheral areas on the outer surface of the inner member thereby enabling the use of a longitudinally pleated material for the inner member. Crimping of spaced portions of the inner member 28*a* as shown at 36*a* in FIG. 7 is relatively simple to accomplish so that discrete inner cavity means 34*a*** can be produced.

The production of a longitudinal pleated material for use in forming cigarette filter elements such as shown at **24*a* can be accomplished by any of various well known prior art techniques which need not be described in detail herein. Yet, the ability to utilize such a pleated inner member 28*a*, as has been explained previously, results in substantially more material of the inner member available for filtration purposes than is possible with the use of a cylindrical inner member as has been necessary with prior art techniques and as is shown in the embodiment of FIGS. 1, 3 and 4.**

Reference is now made particularly to FIGS. 2 and 8 through 10, for the overall method and means utilized in producing filter elements in accordance with this invention. Basically, this overall technique is similar in many respects to the techniques shown and described in detail in U.S. Pat. No. 3,637,447, referred to previously. According to preferred embodiments of this invention, as indicated above, the filtering material utilized in the production of the inner member 28 of the filter elements is a continuous filamentary tow, designated generally by the reference numeral 50, which includes a multiplicity of bondable fibrous members activated by contact with a hot fluid, such as steam. The filtering material 50 is continuously passed into and through an elongated bonding zone including a conventional stuffer jet 52 and steam head 54 utilizing a central mandrel as shown, for example, in FIG. 1 of U.S. Pat. No. 3,637,447 to produce an annular area through which the tow 50 is continuously pulled by the garniture means 56. The tow is contacted in the steam head 54 to produce a smoke-permeable annular wall of bonded fibrous members rendered self-supporting as it is cooled by air or the like in the cooling head 58.

Figure 8:
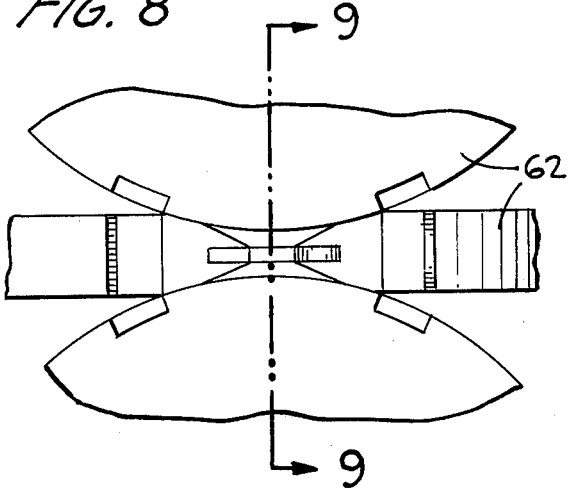
FIG. 8 is a fragmentary elevational view of the crimping means utilized in forming the inner member according to this invention.
Figure 9:
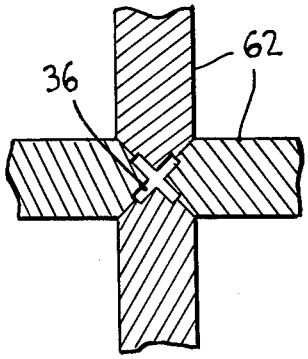
FIG. 9 is a sectional view taken substantially along lines 9—9 of FIG. 8.
Figure 10:
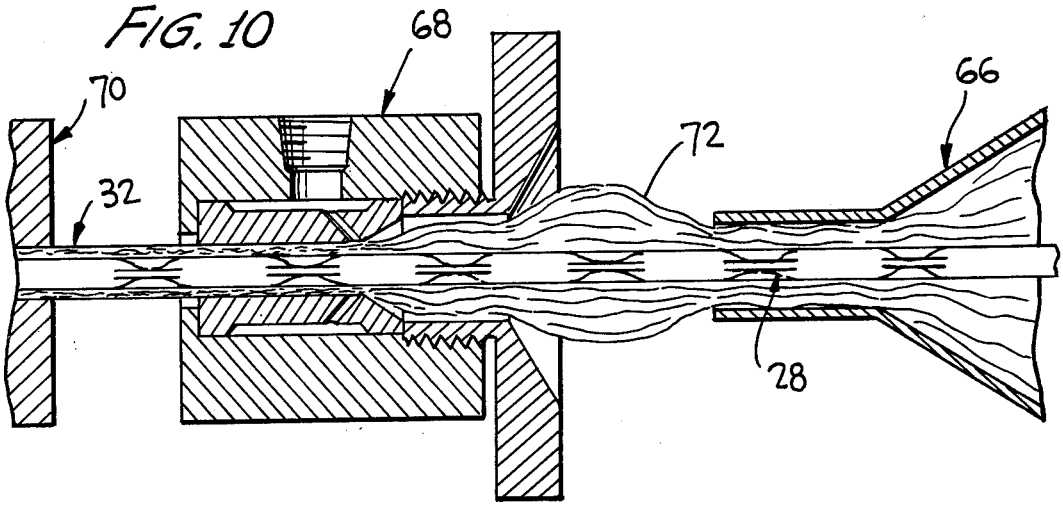
FIG. 10 is a fragmentary sectional view showing the manner in which the intermediate member of the filter element of this invention is formed.

The resultant cylindrical rod is crimped at 60 by a multiplicity of crimping wheels 62, portions of which are schematically shown in detail in FIGS. 8 and 9, to produce discrete, axially spaced, internal cavities 34 sealed at both ends by crimped portions 36. Details of such crimping wheels will be seen, for example, in FIGS. 10–13 of U.S. Pat. No. 3,637,447.

This crimped inner member 28 functions as did the mandrel in the initial bonding zone when it is pulled by the additional garniture means 64 through a further stuffer jet 66, steam head 68 and cooling head 70. The intermediate member 32 is formed about the inner member 28 from a second filamentary tow 72 during this portion of the processing as will be seen in detail in FIG. 10.

After exiting from the cooling head 70 the resultant two-layered rod is overwrapped by a conventional plug wrap 74 in the garniture means 64 to form the outer member 30, and then severed transversely at selected locations in a cutting means such as shown schematically at 76.

From the foregoing it will be seen that the inner member 28 takes a form quite similar to the inner member of the filter element shown in the various prior art patents referred to previously. However, by utilizing the intermediate member 32 of the instant invention, continuous peripheral portions are not necessary on the inner member enabling the use of a pleated inner member, if desired, the distortion caused by the crimping of the inner member is overcome by the smooth outer surface of the intermediate member, and a relatively light weight plug wrap can be utilized for productioon of the outer member 30 while the internal glue line of prior art filters is obviated. Moreover, the air space caused by the outer cavity in prior art constructions is filled by a filtering material which, preferably, is of a different character than the filtering material of the inner member itself, resulting in a depth media or layered effect having selective filtration capabilities.

The following data compares certain characteristics of a product made according to this invention designated as "I" with products according to prior art techniques, a single filter element of the type shown, for example, in U.S. Pat. No. 3,637,447 being designated as "II" and a double filter element of the type shown in U.S. Pat. No. 3,805,801 being designated as "III" in the table below.

| Type | Weight | Pressure Drop | Percent Retention |
|---|---|---|---|
| I | 14.7 grs | 1.5" | 73.2 |
| II | 16.5 grs | 2.8" | 69 |
| III | 13.4 grs | 2.8" | 65 |

It will be seen from the above filter elements prepared according to the instant inventive concepts compared favorably with the prior art filters, while providing at least as good as, and frequently better, filtration efficiency. Other commercially significant properties such as hardness, taste and the like also compare favorably with prior art filter elements. Moreover, as discussed previously, selective filtration is possible with products according to this invention as are novel appearances resulting from the use of different filtration materials for the inner and intermediate members.

It will now be seen that there is herein provided a smoke filter, a method and means for manufacturing same which satisfies the various objectives set forth previously, and which provides significant advantages of a commercial nature. While this invention has been described with reference to presently preferred exemplary embodiments thereof, it should be clearly understood that the invention is not limited thereto, but may be variously practiced within the scope of the following claims.

The embodiment of the invention in which an exclusive property or privilege is claimed are defined as follows:

1. A smoke filter means including a filter element comprising:

a. an axially elongated, hollow, outer member;

b. an axially elongated, hollow, inner member disposed within said outer member and extending at least substantially over the full length of said filter element;

c. an axially elongated, hollow, intermediate member disposed between said inner and outer member at least substantially throughout their lengths;

d. said outer member including an inner surface and having spaced end portions;

e. said inner member comprising a first filtering material and including an inner surface and an outer surface and having spaced end portions;

f. said intermediate member comprising a second filtering material and including an inner surface and an outer surface and having spaced end portions;

g. said outer surface of said intermediate member being juxtaposed to said inner surface of said outer member to at least substantially preclude axial passage or smoke across the area therebetween, and said inner surface of said intermediate member being juxtaposed to said outer surface of said inner member to at least substantially preclude axial passage of smoke across the area therebetween while permitting transverse passage of smoke between said intermediate and inner members; whereby said intermediate member substantially completely fills the spaced between said inner member and said outer member;

h. a integral first portions of said inner member defining a first area extending across the interior of said inner member which offers at least as much resistance to passage of smoke as said first filtering material;

i. second portions of said inner member defining a second area extending across the interior of said inner member which offers less resistance to passage of smoke than said intermediate member, said second portions being axially spaced from said first portions;

j. the interior of said inner member between said first and second portions defining elongated cavity means; and k. said intermediate member offering less resistance to passage of smoke than said inner member;

whereby smoke passing through said filter element must travel through said cavity means and said first and second filtering materials.

2. A cigarette comprising, in combination, a tobacco rod and a filter means secured in end-to-end relationship to one end of said tobacco rod, said filter means including a filter element as defined in claim 1.

3. A filter rod comprising a multiplicity of filter elements as defined in claim 1 integrally connected together with first portions of alternating filter elements in said rod juxtaposed to each other and second portions of alternating filter elements in said rod juxtaposed to each other.

4. A filter element according to claim 1 wherein said first and second filtering materials each comprise a multiplicity of crimped fibrous elements bonded together at their points of contact to define smoke-permeable members each providing a tortuous path for the passage of smoke therethrough, the fibers of said first filtering material being finer than the fibers of said second filtering material and the interstitial spaces in said inner member being smaller than the interstitial spaces in said intermediate member.

5. A filtering element according to claim 4 wherein said first and second filtering materials each comprise cellulose acetate tow.

6. A filter element according to claim 1 wherein portions of said outer surface of said inner member are spaced farther from said inner surface of said outer member than other portions of said outer surface of said inner member along the axial length thereof to define an annular space between said inner and outer members of varying volume, said intermediate member substantially completely filling said annular space.

7. A filter element according to claim 1 wherein one end of said inner member is crimped and sealed together to define said first area and the other end of said inner member is open to define said second area.

8. A filter element according to claim 1 wherein said inner member is longitudinally pleated to define circumferentially alternating, longitudinally extending, portions of the outer surface of said inner member spaced closer to, and further away from, said inner surface of said outer member with the wall thickness of said inner member being substantially uniform along the entire length thereof.

9. A filter element according to claim 8 wherein one end of said inner member is crimped and sealed together to define said first area and the other end of said inner member is open to define said second area.

* * * * *